US005485920A

United States Patent [19]

Fritz

[11] Patent Number: 5,485,920

[45] Date of Patent: Jan. 23, 1996

[54] STACKABLE SPACE SAVING CONTAINER

[76] Inventor: Lawrence E. Fritz, 308 S. Mill St., Apt #207, Fergus Falls, Minn. 56537

[21] Appl. No.: 298,032

[22] Filed: Aug. 30, 1994

[51] Int. Cl.[6] ..... B65D 21/032; B65D 21/036

[52] U.S. Cl. ..... 206/509; 206/510; 220/745; 220/756; 220/768; 222/143; 222/465.1; 222/479

[58] Field of Search ..... 206/504, 509, 206/510; 220/745, 756, 768, 761, 23.6, 23.83; 222/143, 478, 481.5, 465.1, 479

[56] References Cited

U.S. PATENT DOCUMENTS

| | | | |
|---|---|---|---|
| D. 256,218 | 8/1980 | Fritz | D9/55 |
| 2,424,151 | 7/1947 | Clark et al. | 222/478 |
| 2,847,042 | 8/1958 | Edelmann | 222/479 |
| 3,326,425 | 6/1967 | Smith | 222/478 |
| 4,351,454 | 9/1982 | Maynard, Jr. | 222/143 |
| 4,489,839 | 12/1984 | Epperson | 206/509 X |
| 4,573,595 | 3/1986 | Mednis | 206/509 X |
| 4,671,328 | 6/1987 | Mueller | 222/479 X |
| 5,064,101 | 11/1991 | Richter et al. | 206/510 X |

FOREIGN PATENT DOCUMENTS

| | | | |
|---|---|---|---|
| 0204738 | 10/1923 | United Kingdom | 222/465.1 |
| 521057 | 5/1940 | United Kingdom | 206/510 |

*Primary Examiner*—Allan N. Shoap
*Assistant Examiner*—Niki M. Kopsidas
*Attorney, Agent, or Firm*—Curtis V. Harr

[57] ABSTRACT

A Stackable Space Saving Container is disclosed which can be stored or transported in square cases with virtually no wasted space. This container is substantially rectangular having a diagonally slanting upper surface so as to form a rectangular cube when joined with another Stackable Space Saving Container of like size. The container is supplied with a handle and neck as well as a receptacle for each when a pair of Stackable Space Saving Containers are joined. A further embodiment uses a vent tube along the pouring edge of the container so as to allow for quick splash free pours.

10 Claims, 5 Drawing Sheets

STACKABLE SPACE SAVING CONTAINER

BACKGROUND OF THE INVENTION

This invention relates generally to a container and more particularly to a container of the type which is adapted to be stacked in pairs so as to greatly reduce wasted space during shipping and storage.

Numerous pourable products that are used every day in the household come in jugs or bottles, one need not look far to find a variety of such products. Often times the area used to store these containers is very cluttered and marked by much wasted space. One area where the use of such containers is common is the refrigerator, an area which is filled with bottles and jugs holding everything from soda pop and milk to salad dressing and ketchup. A second area of the house filled with containers is the cleaning cabinet which is filled with bottles and jugs of various cleaning solvents. A third area of the house is the garage, which usually has a shelf containing various bottles and jugs with contents ranging from automotive fluids to lawn chemicals.

The first problem with the various types of containers is the space that they waste both during shipping and mass storage, as well as on a household shelf. When a garage or refrigerator shelf gets full of various bottles and jugs it is readily apparent that the space around the neck area or tops of the containers is wasted. This problem can be especially serious during mass storage and shipping when bottles or jugs are often placed in cases for handling. The upper half of these cases or cartons is usually wasted space filled with dead air, as the case must be made big enough to accommodate the necks of the containers. Another problem with these containers is that they are often rounded, such as bottles, and requires dividers in the cases to keep them from shifting or crashing into each other during storage. The use of dividers is an added cost and creates more dead air space in the crate during shipping and storage.

A second problem with the standard bottles or jugs is that they can be hard to pour. When a bottle of liquid is poured to fast a vacuum is created in the bottom of the bottle, as there is no vent to allow air to replace the leaving liquid. This vacuum causes air to be pulled into the bottle or jug resulting in splashing of the liquid as well as a slow down in pouring. The splashing caused by this vacuum can be very dangerous especially when pouring hazardous chemicals. A still further problem with pouring occurs in tight situations such as when pouring an additive in the gas tank of an automobile often times when the neck of the container is placed in the gas spout the container can not be tilted far enough to completely dispense all of its contents.

A third problem with the standard bottle or jug is the ease of handling. A handle is usually desirable on these containers to assist in handling and pouring. However, the design of a standard bottle often does not allow for the placement of a handle on the bottle.

It can be seen from the foregoing discussion that it is desirable to have a container that efficiently utilizes space so as to minimize or eliminate wasted space during shipping and storage. Second it is important to have a container that allows for easy dispensing with no splashing and minimal tipping angle required to allow the container to completely dispense all of its contents. Finally it is desirable to have a container design that can be easily held and handled.

SUMMARY OF THE INVENTION

The objects of this invention are of providing a container for pourable liquids that can be efficiently packed for storage and shipping and which also minimizes wasted shelf space, while allowing for easy pouring with minimal splashing and tip angle and finally a container that can be easily handled. These ends are accomplished by providing a Stackable Space Saving Container preferably made from blow molded plastic, having a diagonal flat upper surface formed in such a manner so as to fit with a like inverted and reversed container to form an easily storable cube.

The body of the Stackable Space Saving Container is substantially a rectangular body having a diagonal cut running from a top corner to a position lower on the opposite edge of the cube. The body of this container is provided with a cylindrical neck extending upward from the top corner of the body. The lower edge of the container is provided with a cylindrical groove cut to match the neck of a like reversed and inverted Stackable Space Saving Container.

The diagonal surface of the Stackable Space Saving Container is supplied with a handle positioned on the upper half of the diagonal surface and aligned with the center of gravity of the container. This position of the handle over the center of gravity allows the container to hang evenly when it is held by the handle. The lower half of the upper diagonal surface is supplied with a notched handle receptacle positioned and aligned in such a manner so as to match the handle of a reversed and inverted like container when stacked.

The Stackable Space Saving Container may be provided with a vent tube running vertically from the top of the neck substantially to the bottom of the container and positioned along the rear edge of the body and neck. The use of the vent tube allows air to enter the container during dispensing of the containers contents. This tube allows for ease in pouring without splashes. During pouring the container is tipped towards the lower edge of the diagonal surface, in this position when the container is tilted 45 degrees from level the container will completely dispense its contents.

Various methods of sealing the container may be utilized. However, the preferred method is a cap with threads and threads about the top of the Stackable Space Saving Container. The use of a cork or a plug may also be suitable in some situations. A still further option is the use of ridges about the back edge of the container neck to assist in the handling of the container.

In the stacking configuration two containers form a rectangular cube. By forming a cube multiple Stackable Space Saving Containers can be stored or carried in a crate, case, or even a cooler with little or no wasted space. This feature can be invaluable during mass storage or shipping where space is at a premium.

The above described features and advantages of novelty are pointed out with particularity in the claims of the present application. However, for a better understanding of the present invention, reference should be made to the drawings in which there is illustrated and described preferred embodiments of the present invention.

DESCRIPTION OF THE PREFERRED EMBODIMENT

Figure 1:
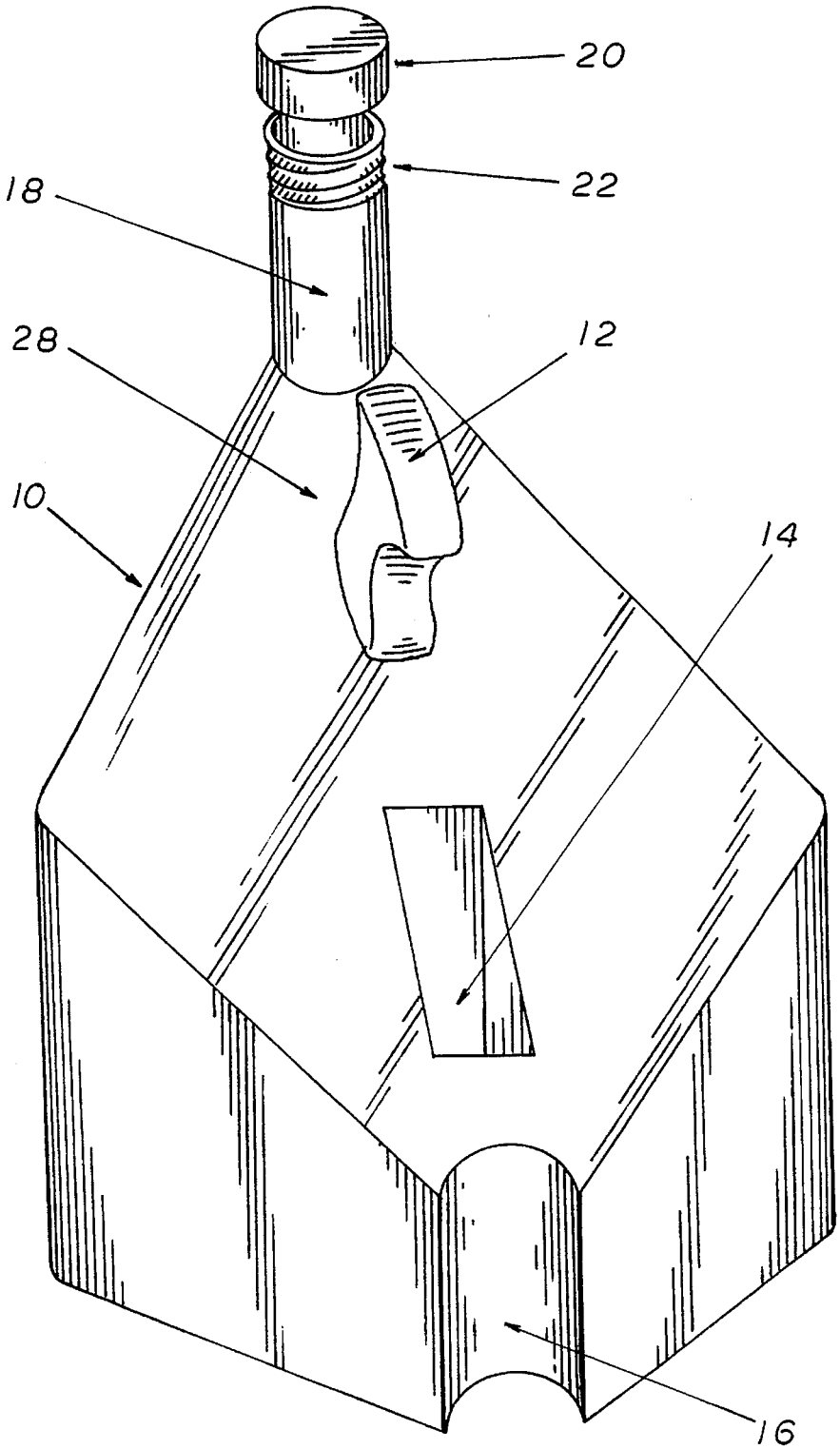
FIG. 1 is a perspective view of the Stackable Space Saving Container showing the important components of the container and their relationship to one another.

Referring to the accompanying drawings a Stackable Space Saving Container as used in the holding and dispensing of liquids embodies various features of the invention as shown. In the illustrated embodiment, the present invention comprises a Stackable Space Saving Container 10. It must be stated that the present invention is equally applicable to other applications which incorporates the dispensing of a substance from a bottle or a jug.

FIGS. 1, 2, 3 and 4 show the various components of the Stackable Space Saving Container 10 and their orientation on the present invention. The interlocking handle 12 serves as both a carrying handle for an individual Stackable Space Saving Container 10 and locking mechanism which locks into the corresponding interlocking handle slot 14 on another Stackable Space Saving Container 10 thus forming a joined pair 30. The neck 18 and cap 20 which is secured to the neck 18 by the use of threads 22, of the present invention fit tightly into the corresponding notched neck receptacle 16 on another Stackable Space Saving Container 10 when they are fitted together to form a joined pair 30. Also shown by these figures is the diagonal top container surface 28 of the present invention and how these surfaces of two Stackable Space Saving Container 10 fit together when configured in a joined pair 30.

Figure 2:
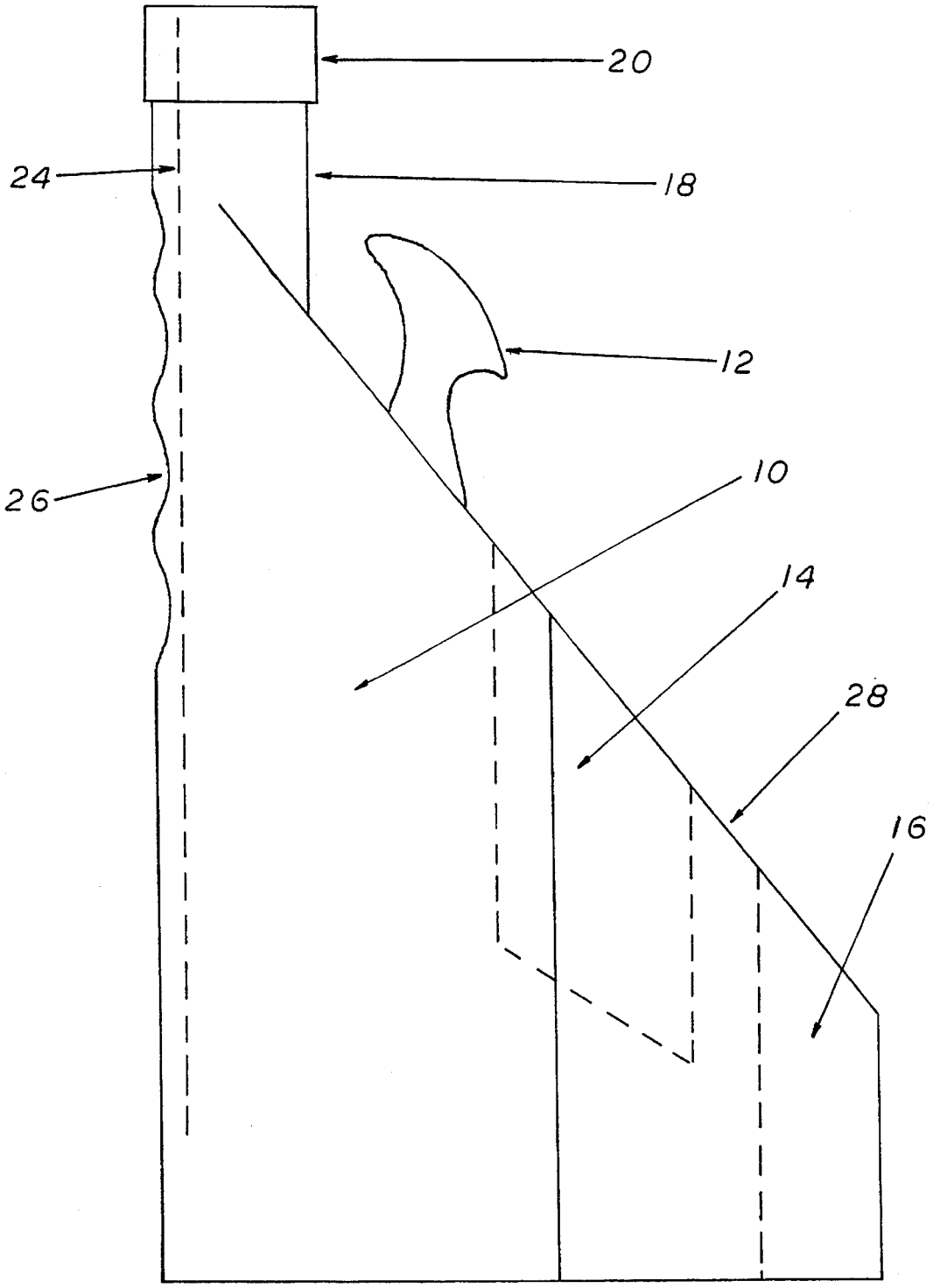
FIG. 2 is a side elevation view of the Stackable Space Saving Container using hidden lines to show the internal features of the container and their orientation to the other components of the container.
Figure 3:
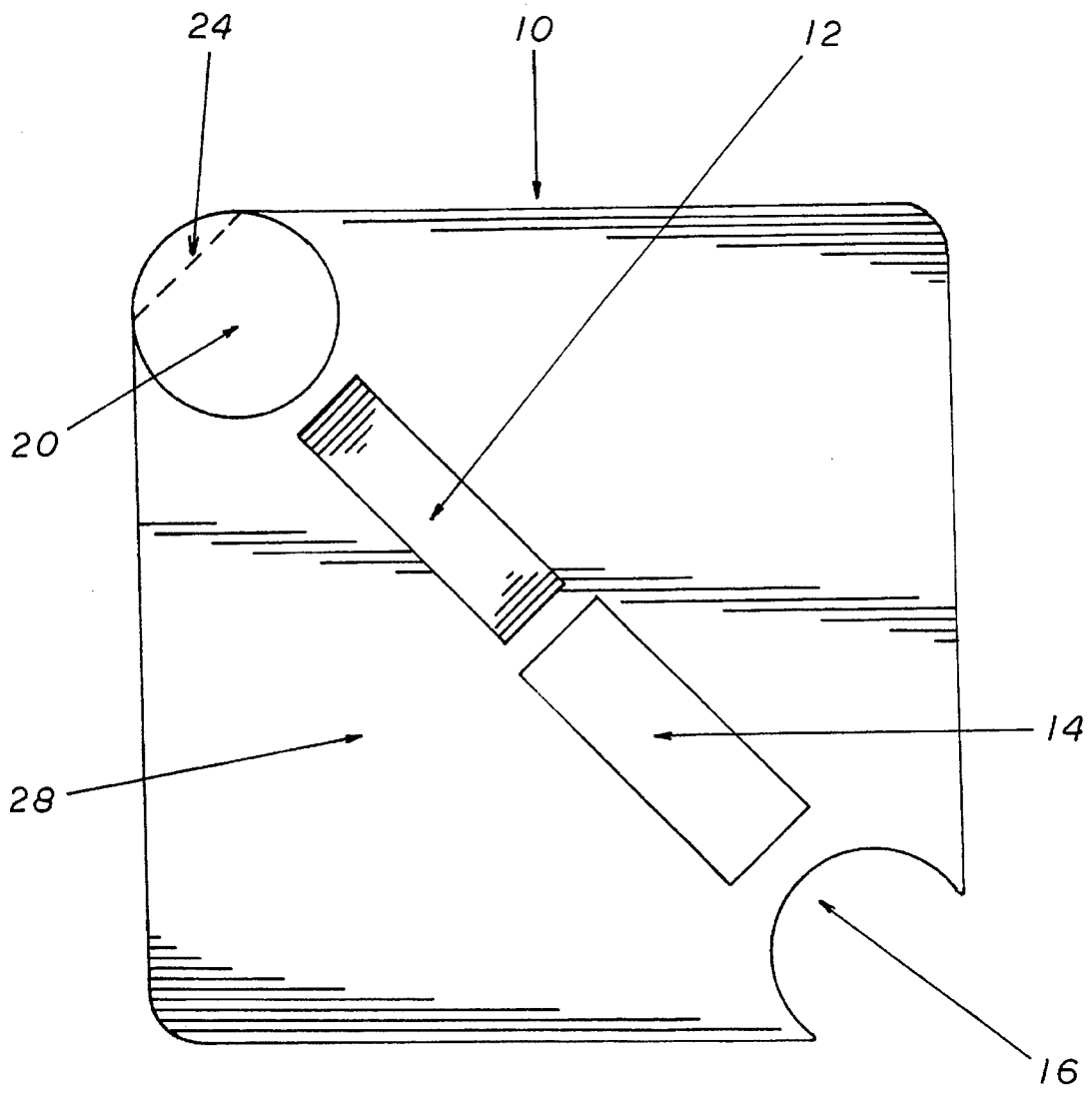
FIG. 3 is a top elevation view of the Stackable Space Saving Container showing the orientation of the components from this perspective.

FIG. 2 shows the orientation of the optional ribbed handle 26 of the Stackable Space Saving Container 10 and along with FIG. 3 also shows the orientation of the vent tube 24 which allows for the smooth flow of storable liquid when pouring said liquids from the present invention by allowing air to enter the body of the Stackable Space Saving Container 10.

Figure 4:
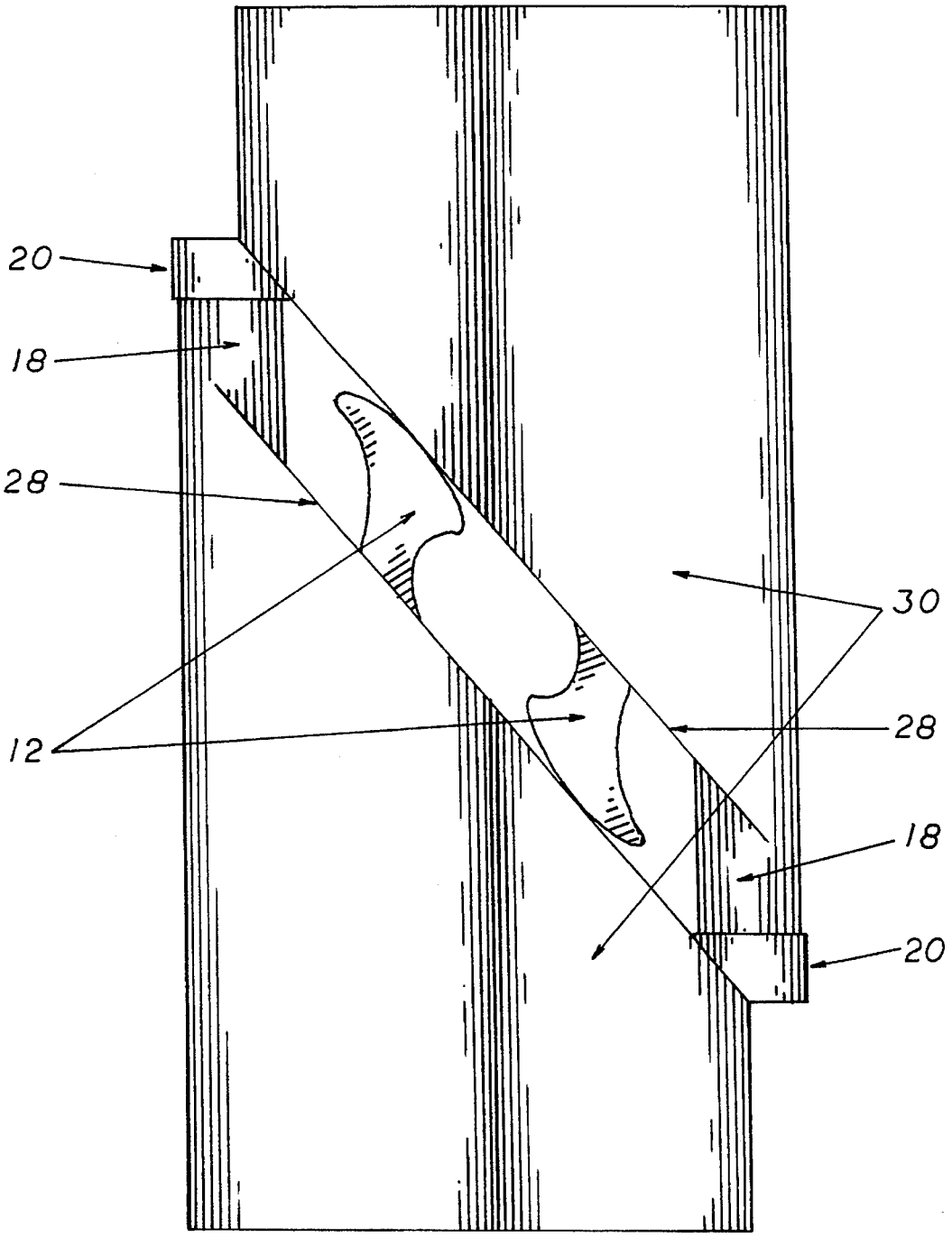
FIG. 4 is a side elevation view of two Stackable Space Saving Containers inverted and reversed in respect to one another showing how the interlocking components of each fit together in this position to form a joined pair which then forms a rectangular cube.

FIG. 4 shows the method by which two Stackable Space Saving Container 10 are fitted together to from a joined pair 30. The two containers are inverted and reversed in respect to one another where the neck 18 and caps 20 of each fit into the notched neck receptacles 16 of the other and the interlocking handles 12 of each lock into the interlocking handle slots 14 of the other.

Figure 5:
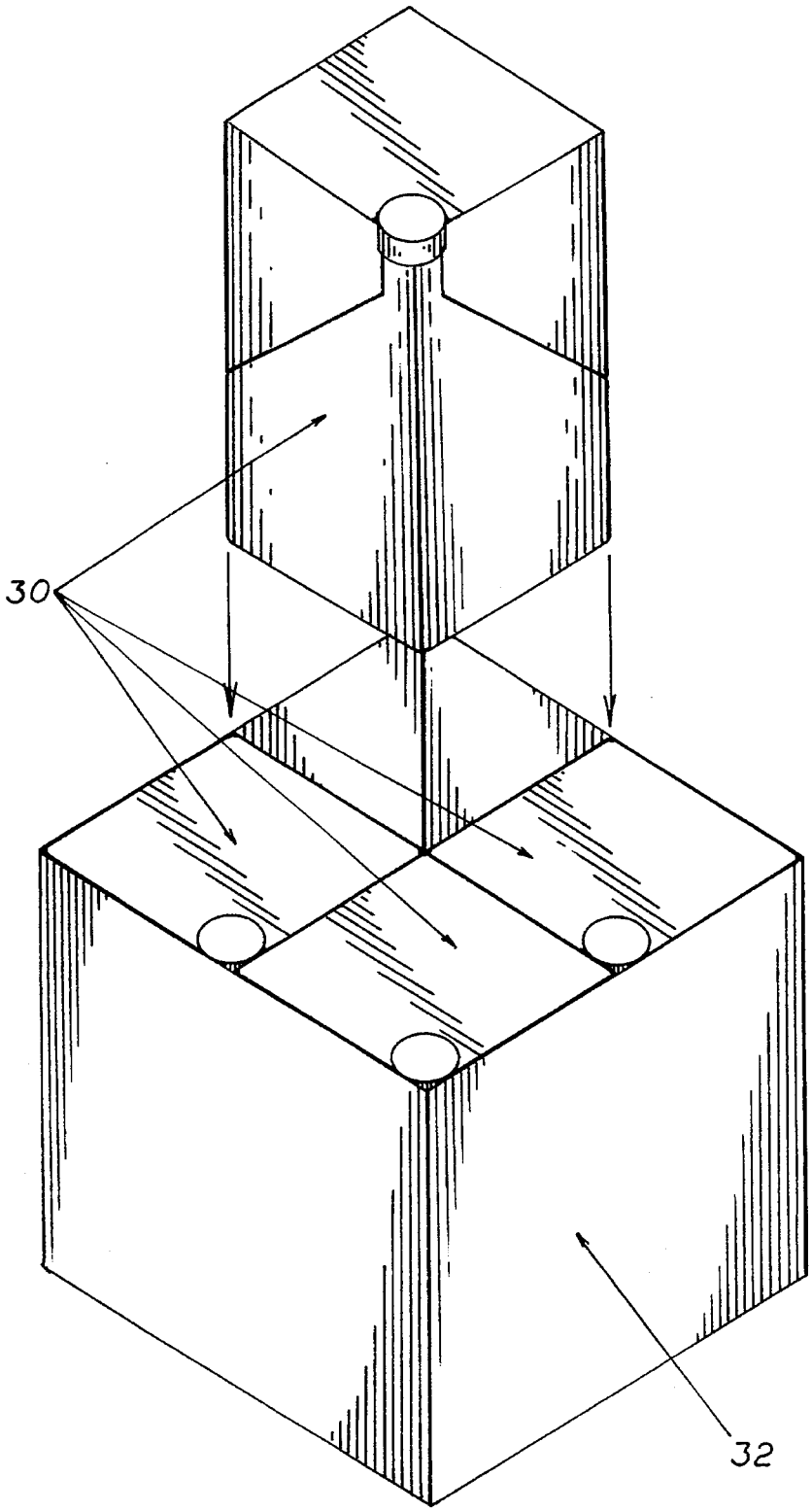
FIG. 5 is perspective view of a box container showing how two joined Stackable Space Saving Containers will fit into said box case with three other joined pairs of Stackable Space Saving Containers.

FIG. 5 shows the use of a case 32 which can hold and store a specified number of joined pairs 30 by stacking the joined pairs 30 next to each other and within the case 32.

Although the present invention has been described in considerable detail with reference to certain preferred versions thereof, other versions are possible such as different handle and handle receptacle configurations as well as different shapes for the body of the container such as a cylinder or multi-sided configuration. Therefore, the spirit and scope of the appended claims should not be limited to the description of the preferred versions contained herein.

What is claimed is:

1. A stackable space saving container comprising:

a half rectangular body cut substantially diagonally from a corner edge to an opposite edge lower on the cube so as to define the body of said container;

a cylindrical neck extending from the upper edge of said body;

said body further having a portion along the lowest cut edge defining a cylindrical groove;

a handle on the upper half of the diagonal surface defined by said diagonal cut;

and said diagonal surface having on its lower half a portion defining an inward handle receptacle.

2. The stackable space saving container in claim 1 wherein said cylindrical neck is supplied with threads about its upper end for receiving a cap and a threaded cap.

3. The stackable space saving container in claim 2 wherein said handle is solid and formed to be held by two fingers.

4. The stackable space saving container in claim 1 wherein said body is further supplied with ridges about the rear of the neck and container.

5. A stackable space saving container comprising:

a half rectangular body cut substantially diagonally from a corner edge to an opposite edge lower on the cube so as to define the body of said container;

a cylindrical neck extending from the upper edge of said body;

a vent tube on the inner edge of the container neck running vertically from the top of the neck substantially to the bottom of the container;

said body further having a portion along the lowest cut edge defining a cylindrical groove;

a handle on the upper half of the diagonal surface defined by said diagonal cut;

and said diagonal surface having on its lower half a portion defining an inward handle receptacle.

6. The stackable space saving container in claim 5 wherein said cylindrical neck is supplied with threads about its upper end for receiving a cap and a threaded cap.

7. The stackable space saving container in claim 6 wherein said handle is solid and formed to be held by two fingers.

8. The stackable space saving container in claim 5 wherein said body is further supplied with ridges about the rear of the neck and container.

9. A stackable space saving container comprising:

a body cut substantially diagonally from an upper region to an opposite lower region on said body;

a cylindrical neck extending from the upper edge of said body;

a vent means on the inner edge of said cylindrical neck running vertically from the top of the neck substantially to the bottom said body;

said body further having a portion along the lowest cut region a cylindrical groove;

a handle on the upper half of the diagonal surface defined by said diagonal cut;

said diagonal surface having on its lower half a portion defining an inward handle receptacle;

and a means of sealing said container.

10. The stackable space saving container of claim 9 wherein the means of sealing said container comprises threads about the neck of said container and a cap supplied with threads.

* * * * *